US005095676A

United States Patent [19]

Mühle

[11] Patent Number: 5,095,676

[45] Date of Patent: Mar. 17, 1992

[54] SECTIONAL FRAME AND SECTIONAL INSERT

[76] Inventor: Manfred Mühle, Tulpenstr. 11, D4972, Löhne 2, Fed. Rep. of Germany

[21] Appl. No.: 585,095

[22] PCT Filed: Mar. 25, 1989

[86] PCT No.: PCT/DE89/00194

§ 371 Date: Sep. 28, 1990

§ 102(e) Date: Sep. 28, 1990

[87] PCT Pub. No.: WO89/09321

PCT Pub. Date: Oct. 5, 1989

[30] Foreign Application Priority Data

Mar. 31, 1988 [DE] Fed. Rep. of Germany ..... 8804368

[51] Int. Cl.[5] ..... E04B 9/00

[52] U.S. Cl. ..... 52/476; 52/397; 52/766

[58] Field of Search ..... 52/397-399, 52/476, 764, 766

[56] References Cited

U.S. PATENT DOCUMENTS

| | | | |
|---|---|---|---|
| 3,090,085 | 5/1963 | Brown . | |
| 3,155,422 | 11/1964 | Campbell et al. | 52/397 X |
| 3,212,225 | 10/1965 | Neal | 52/397 X |
| 3,805,470 | 4/1974 | Brown | 52/397 X |
| 4,164,830 | 8/1979 | Bierlich | 52/764 X |
| 4,525,966 | 7/1985 | Litchfield et al. | 52/397 |
| 5,036,637 | 8/1991 | Biebuyck | 52/397 X |

FOREIGN PATENT DOCUMENTS

| | | | |
|---|---|---|---|
| 1072796 | 1/1960 | Fed. Rep. of Germany | 52/764 |
| 1813632 | 7/1970 | Fed. Rep. of Germany . | |
| 2712691 | 9/1978 | Fed. Rep. of Germany | 52/397 |
| 2915255 | 10/1979 | Fed. Rep. of Germany . | |
| 8108780 | 1/1986 | Fed. Rep. of Germany . | |
| 2020169 | 7/1970 | France . | |
| 2162748 | 7/1973 | France . | |
| 190235 | 6/1964 | Sweden | 52/764 |
| 1174093 | 12/1969 | United Kingdom | 52/397 |
| 2190418 | 11/1987 | United Kingdom . | |

*Primary Examiner*—David A. Scherbel
*Assistant Examiner*—Lan Mai
*Attorney, Agent, or Firm*—Max Fogiel

[57] ABSTRACT

A sectional frame and insert arrangement in which one contact surface on the insert rests against the frame, and the insert has a flange with a foot-shaped cross-section extending into a channel with a C-shaped cross-section. The flange has an impact surface that extends perpendicular to the contact surface and rests against the wall of the channel. The flange has a snap-in edge that engages below and can be released from the head of another wall having a T-shaped cross-section and being positioned opposite the first wall. Positioners enclosing at least partly the inserted area of the snap-in edge of the foot-section flange, are inserted into a longitudinal snap-in groove. The positioners have resilient tongues above the snap-in edge resting against the head of the T-section wall.

6 Claims, 2 Drawing Sheets

SECTIONAL FRAME AND SECTIONAL INSERT

BACKGROUND OF THE INVENTION

The invention concerns sectional framing and sectional insert, whereby one contact surface on the insert rests against the framing, the insert has a flange with a foot-shaped cross-section that extends into a channel with a C-shaped cross-section, the flange has an impact surface that extends perpendicular to the contact surface and rests against the wall of the channel, and the flange has a snap-in edge that engages below and can be released from the head of another wall that has a T-shaped cross-section and is positioned opposite the first wall.

Known sectional framing of this type is described in German Patent 1 509 900. A resilient two-flanged positioner has a base that fits into an accommodation for a pane of glass in the framing. A lateral extension of the base slopes up and is tensioned into a longitudinal groove in the insert. The description implies that the base supports the pane and prevents it from coming into contact with metal.

Experience with the aforesaid resilient positioner, however, reveals that its upward sloping lateral extension complicates glazing to the extent that the extension cannot as intended be inserted into the C-section channel in the framing before the glass is positioned but only afterward. The known positioner is accordingly unable to support the pane as intended and must even be unwieldily forced in under the pane in order to secure it in the framing. In the case of already assembled frames, again, all the positioners must initially be removed from the framing again at the beginning of the glazing process, which entails additional assembly expenditure even if they do not become mislaid at the site.

SUMMARY OF THE INVENTION

Given these drawbacks, it is the object of the invention to provide framing wherein, in order to eliminate glazing problems, the resilient positioners are associated with the insert instead of with the framing and can accordingly easily be fitted already secured to the insert into the framing or removed therefrom when necessary. Another advantage of this approach is that the correct number and type of positioners as dictated at the factory will always be available, ensuring that they will fit tight into the framing. Finally, considerably less material will be needed for the resilient positioners.

The particular design that attains this object is characterized in the claims. In accordance with the major feature of the new framing, accordingly, the positioners at least partly enclose the inserted area of the snap-in edge of the foot-section flange, are inserted into a longitudinal snap-in groove, and have resilient tongues above the snap-in edge that rest subject to tension against the head of the T-section wall. Advanced versions of the invention represent perfections with respect to how the invention is mounted and functions.

Some embodiments of the invention will now be described by way of example with reference to the cross-sections illustrated in the figures.

DESCRIPTION OF THE PREFERRED EMBODIMENTS

Figure 1:
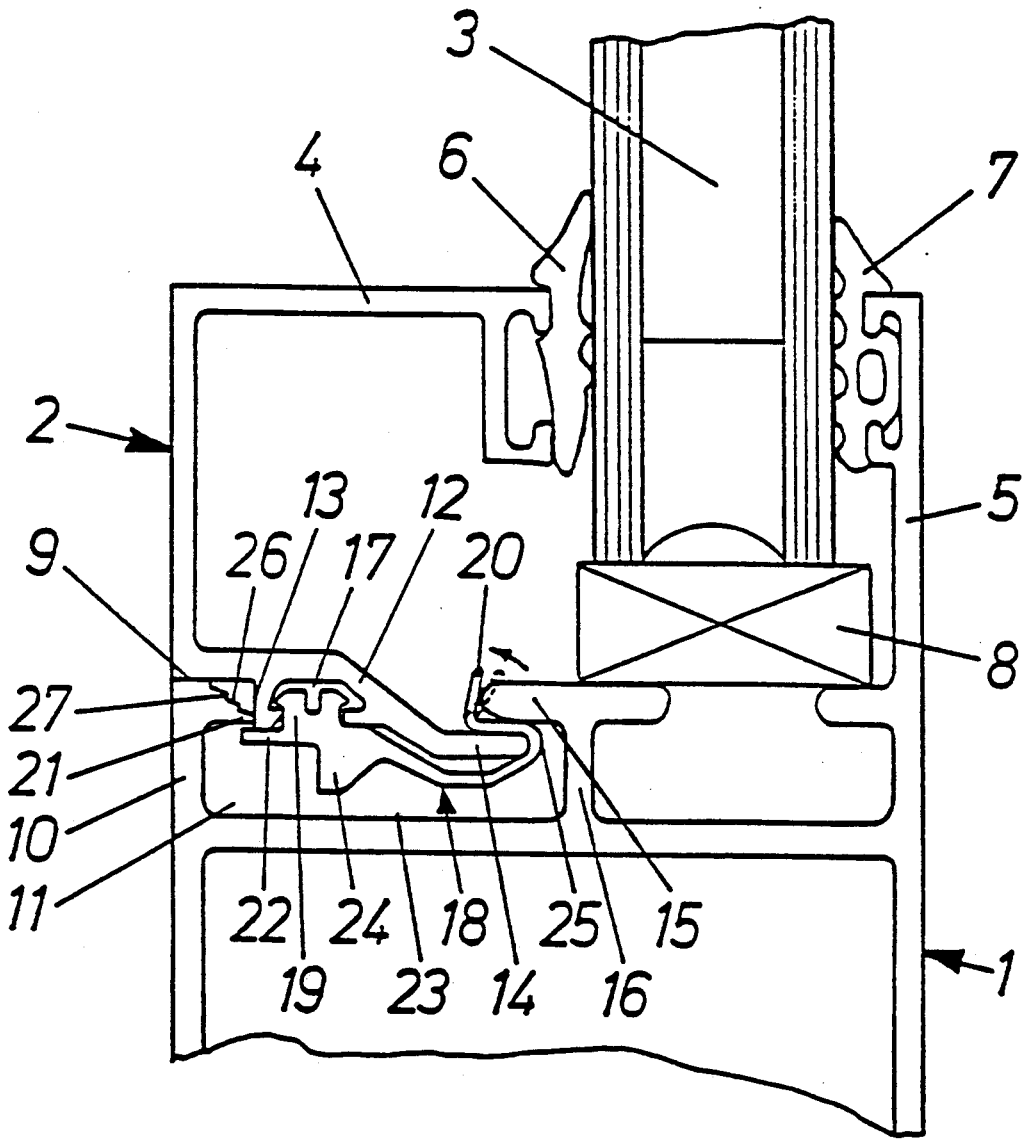
FIG. 1 is a partial sectional view of the frame and insert, in accordance with the present invention.

As will be evident from the figures, each length of sectional framing 1 is associated with a length of sectional insert 2. Insert 2 secures a pane 3 of insulating glass in framing 1 by means of a sealing strip 6 between the free side 4 of the insert and pane 3 and by means of another sealing strip 7 between the free side 5 of framing 1 and the pane.

One contact surface 9 on insert 2 rests against the undercut wall 10 of a channel 11 with a C-shaped cross-section. Insert 2 also has a flange 12 with a foot-shaped cross-section that extends into channel 11. Flange 12 has an impact surface 13 that extends perpendicular to contact surface 9 and rests against the wall 10 of channel 11. Flange 12 also has a snap-in edge 14 that engages below the head 15 of another wall 16 that has a T-shaped cross-section and is positioned opposite first wall 10.

Figure 2:
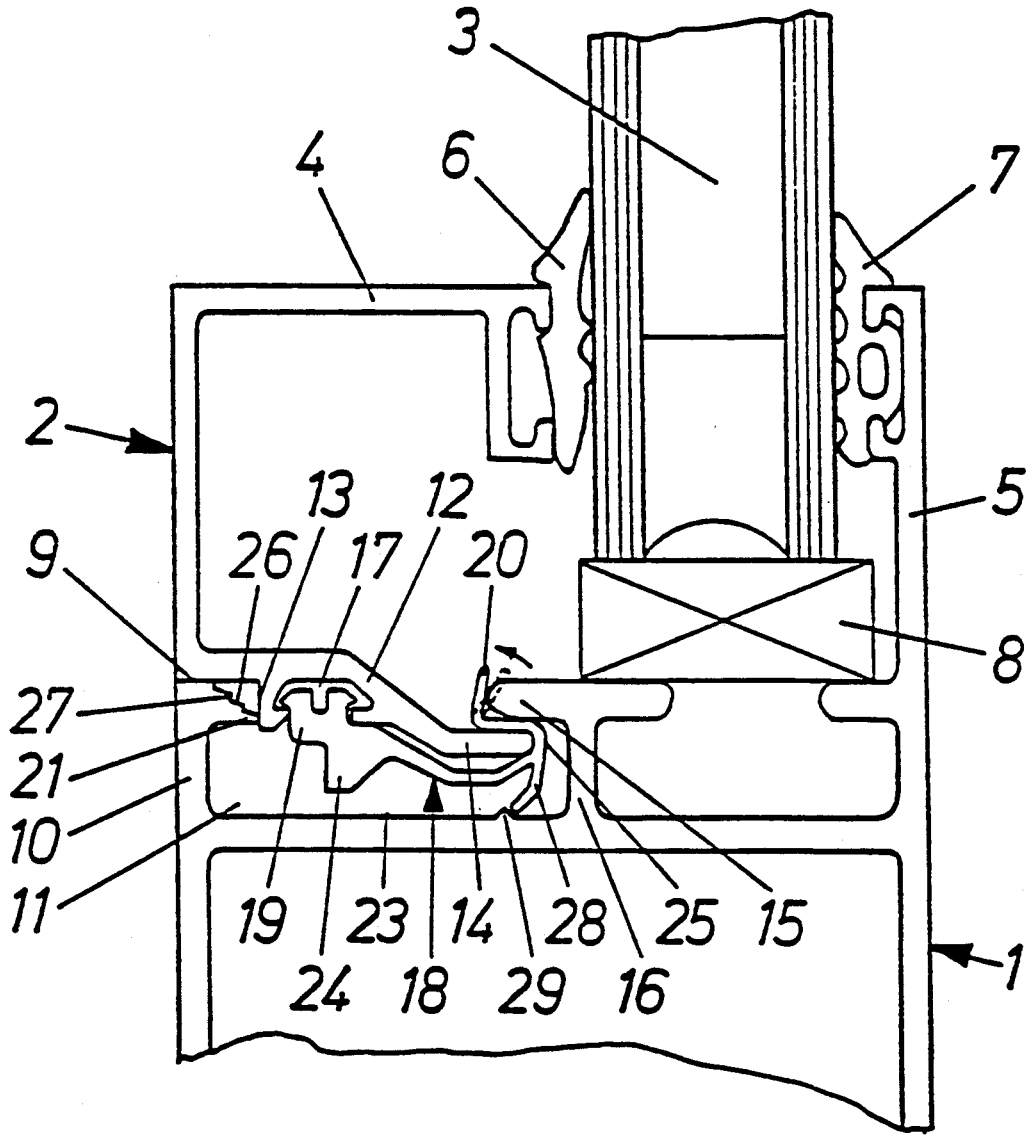
FIG. 2 is a partial sectional view of another embodiment of FIG. 1.

Flange 12 is secured in and can be released from the channel 11 in framing 1 by means of resilient positioners 18, preferably made of plastic. Each positioner has a snap-in bead 19 that snaps into a groove 17 that extends along the bottom of the flange. Resilient positioners 18 enclose the inserted area of snap-in edge 14. Integrated into positioners 18 are resilient tongues 20 that rest under tension against the head 15 of second undercut wall 16 above snap-in edge 14. This design ensures that flange 12 will be forced, once it has been introduced into groove 11, with its impact surface 13 against the counteracting edge 21 of first wall 10 and will not come loose from it once sealing strip 6 has been inserted. Additional security is provided by the lock-in pins 22 illustrated in FIG. 1, which extend from the snap-in bead 19 on positioner 18 to below counteracting edge 21. Instead of lock-in pins, the embodiment illustrated in FIG. 2 has lock-in projections 28 that extend down from the vicinity of the face 25 of positioner 18 and resiliently engage a stop 29 on the bottom 23 of the groove 11 in framing 1. Stop 29 can be either an elevation as illustrated or a depression.

To facilitate positioning flange 12 while it is being inserted in the groove 11 in framing 1, resilient positioners 18 have impact cams 24 that extend toward the bottom 23 of the groove. The cams are slightly less far away from the face 25 of positioner 18 that confronts second wall 16 than the extent that groove 11 is open. It is accordingly possible when beginning to mount insert 2 to initially rest it against first wall 10 with impact cams 24 coming to rest against counteracting edge 21. Insert 2 is then tipped slightly toward pane 3 and can slide in below the head 15 of T-sectioned second wall 16 with positioners 18 around the snap-in edge 14 of flange 12. This procedure is facilitated by a surface 26 on the upper web of the wall 10 of groove 11 that slopes down in the direction that flange 12 is inserted in. If sloping surface 26 also has steps 27 like those in the illustrated embodiment, flange 12 will be subjected to increasing tension while it is being introduced into groove 11, which also facilitates assembly.

I claim:

1. Sectional framing system comprising a sectional frame, a sectional insert, and a plurality of positioners;

said sectional frame comprising a channel having a C-shaped cross section and a first wall, and a second wall having a head and a T-shaped cross section and is positioned opposite said first wall;

said insert comprising a contact surface and a flange; said contact surface rests against said sectional frame; said flange having a longitudinal snap-in groove, a foot-shaped cross section that extends into said channel, and a bottom; said flange further having an impact surface that extends perpendicular to said contact surface, and a snap-in edge having an inserted area, said snap-in edge releasably engages below said head of said second wall;

wherein said positioners at least partly enclose the inserted area of said snap-in edge, are inserted into said snap-in groove, and have resilient tongues located above said snap-in edge; said resilient tongues, when subject to tension, rest against said head of said second wall.

2. Sectional framing system as in claim 1, whereby each of said positioners further includes snap-in beads that are inserted into said snap-in groove; said snap-in groove is located on the bottom of said flange.

3. Sectional framing as in claim 2, characterized in that lock-in pins further include extend from said snap-in bead on the resilient positioner; said first wall further includes counteracting edge, whereby said lock-in pins extend below the counteracting edge of the first wall that the flange rests against.

4. Sectional framing located below said lock-in pins as in claim 1, characterized in that said resilient positioners have impact cams that extend toward the bottom of the groove and are slightly less far away from the face of the positioner that confronts the second wall than the extent that the groove is open system.

5. Sectional framing system as in claim 1, wherein the positioners further includes lock-in projections located below said resilient tongues; said sectional frame having a groove with a bottom located between said first wall and said second wall; said groove further having a stop on the bottom; said lock-in projections being engaged to said stop.

6. Sectional framing system as in claim 1, wherein said first wall has a surface with steps that slopes down toward said flange.

* * * * *